US008545688B2

(12) United States Patent
Nishikiori et al.

(10) Patent No.: US 8,545,688 B2
(45) Date of Patent: Oct. 1, 2013

(54) METHOD FOR ELECTROCHEMICALLY DEPOSITING CARBON NITRIDE FILMS ON A SUBSTRATE

(75) Inventors: Tokujiro Nishikiori, Kyoto (JP); Hiroaki Amahashi, Fukuchiyama (JP); Kouji Kuroda, Fukuchiyama (JP); Yasuhiko Ito, Kyotanabe (JP); Kazuhito Fukasawa, Uji (JP); Naohiro Yasuda, Yokkaichi (JP)

(73) Assignees: Toyota Boshoku Kabushiki Kaisha, Aichi (JP); IMSEP Co., Ltd., Kyoto (JP); SEC Carbon Limited, Hyogo (JP); The Doshisha, Kyoto (JP)

( * ) Notice: Subject to any disclaimer, the term of this patent is extended or adjusted under 35 U.S.C. 154(b) by 796 days.

(21) Appl. No.: 12/789,959

(22) Filed: May 28, 2010

(65) Prior Publication Data

US 2011/0290656 A1 Dec. 1, 2011

(51) Int. Cl.
*C25D 3/66* (2006.01)

(52) U.S. Cl.
USPC ..... 205/230; 205/316

(58) Field of Classification Search
USPC ..... 205/230
See application file for complete search history.

(56) References Cited

U.S. PATENT DOCUMENTS

| | | | |
|---|---|---|---|
| 6,617,058 | B2 | 9/2003 | Schier |
| 6,658,895 | B2 | 12/2003 | Lieberman et al. |

FOREIGN PATENT DOCUMENTS

| | | | |
|---|---|---|---|
| JP | 6-88291 | | 3/1994 |
| JP | 11-189472 | | 7/1999 |
| JP | 2001-232501 | | 8/2001 |
| JP | 2006169554 | A * | 6/2006 |

OTHER PUBLICATIONS

Fu et al., "Attempt to Deposit Carbon Nitride Films by Electrodeposition from an Organic Liquid" in Phys. Rev. B 59(3), pp. 1693-1696 (1999).*

Oishi et al., "Formation of Carbon Nitride by Anode-Discharge Electrolysis of Molten Salt" in J. Electrochem. Soc. 149(11), pp. D178-D181 (2002).*

English Abstract of JP2006-169554A.*

U.S. Appl. No. 12/789,848 to Tokujiro Nishikiori et al., filed May 28, 2010.

Amy Y.Liu et al., ""Structural properties and electronic structure of low-compressibility materials: β-Si3N4 and hypothetical β-C3N4"", Physical Review B—vol. 41 No. 15, May 1990, pp. 10727-10735.

Edwin Kroke et al., ""Novel group 14 nitrides"", Coordination Chemistry Reviews, 248 (2004), pp. 493-532.

* cited by examiner

*Primary Examiner* — Luan Van
*Assistant Examiner* — Bryan D. Ripa
(74) *Attorney, Agent, or Firm* — Greenblum & Bernstein, P.L.C.

(57) ABSTRACT

Dense carbon nitride films are electrochemically formed on a conductive substrate by placing the substrate acting as cathode in a molten salt electrolyte bath and applying DC current across the substrate and a counter electrode acting as anode also placed in the molten salt electrolyte bath. Carbonate ion and nitrate ion are concurrently reduced to deposit carbon nitride films on the substrate.

16 Claims, 3 Drawing Sheets

METHOD FOR ELECTROCHEMICALLY DEPOSITING CARBON NITRIDE FILMS ON A SUBSTRATE

FIELD OF THE INVENTION

The present invention relates to a method for electrochemically depositing carbon nitride films on a conductive substrate using a molten salt electrolyte bath.

BACKGROUND ART

Carbon nitride such as $\beta$-$C_3N_4$ having the same crystalline structure as $\beta$-$Si_3N_4$ is one of most advanced and attractive material in recent years. $\beta$-$C_3N_4$ is expected to have a bulk modulus as high as 420-560 GPa which is comparable to that of diamond of 443 GPa. It also has an expected shear modulus as high as 300-400 GPa corresponding to that of boron nitride. See, A. Y. Liu and M. L. Cohen, Phys. Rev., B41: 10727 (1990). By virtue of these properties, carbon nitride is expected to be highly valuable as surface protection films of cutting tools and also as materials having high thermal conductivity.

In the course of studying $\beta$-$C_3N_4$, a variety of other forms of carbon nitride including cubic carbon nitride and amorphous carbon nitride have been discovered. See, E. Kroke and M. Schwartz, Coordination Chem. Rev., 248:493 (2004). These new forms of carbon nitride are attracting increasing attention as well and include those having unique properties such as high hardness and high wear resistance or capability of varying band gaps.

Carbon nitride films have hitherto been produced by reacting carbon and nitrogen at a temperature above 2000° C. using plasma or laser beam. See, JP 11189472A, JP 2001232501A and U.S. Pat. No. 6,658,895B2. These methods require complicated and expensive apparatus and, therefore, make the cost of resulting products economically unacceptable.

H. Kawamura and Y. Ito reported in Journal of Applied electrochemistry, 30:571 (2000) a method for electrochemically depositing carbon films on a substrate using a molten salt electrolyte bath containing carbonate ion. The carbonate ion is reduced to deposit a carbon film on the surface of the substrate acting as cathode. As will be easily appreciated, this method per se is not applicable to deposit carbon nitride films on a substrate.

A need exists, therefore, for a novel method for depositing carbon nitride films on a substrate which can eliminate or ameliorate of the defects of the known methods while taking advantages of electrodeposition process.

SUMMARY OF THE INVENTION

We have found that carbon nitride films can be deposited electrochemically on a substrate made of conductive materials.

According to the present invention, a method for electrochemically depositing carbon nitride films on a conductive substrate is provided comprising the steps of:

providing a molten salt electrolyte bath containing a source of carbonate ion and a source of nitrate ion;

placing a conductive substrate and a counter electrode in said electrolyte bath, said substrate and said counter electrode being electrically connected to a DC current source and acting as cathode and anode, respectively; and applying DC current across said substrate and said counter electrode through said electrolyte bath whereby said carbonate ion and said nitrate ion are electrochemically reduced concurrently to deposit a carbon nitride film on the substrate.

The molten salt electrolyte bath may comprise either (a) a mixture of an alkali metal or alkaline earth metal carbonate and an alkali metal or alkaline earth metal nitrate, or (b) an alkali metal or alkaline earth metal halide containing said mixture (a). The molten salt electrolyte bath (b) is preferable.

In a preferred embodiment, the source of carbonate ion and the source of nitrate ion are added to a binary mixture of alkali metal halides such as a binary mixture of LiCl and KCl.

The present invention allows carbon nitride films to deposit on the surface of a conductive substrate under mild conditions using simple apparatus. The method according to the present invention is particularly advantageous in that it enables the carbon nitride film to deposit on a substrate having any shape or contour due to a throwing power as high as that of electrolytic metal plating process.

DETAILED DESCRIPTION OF THE INVENTION

Figure 1:
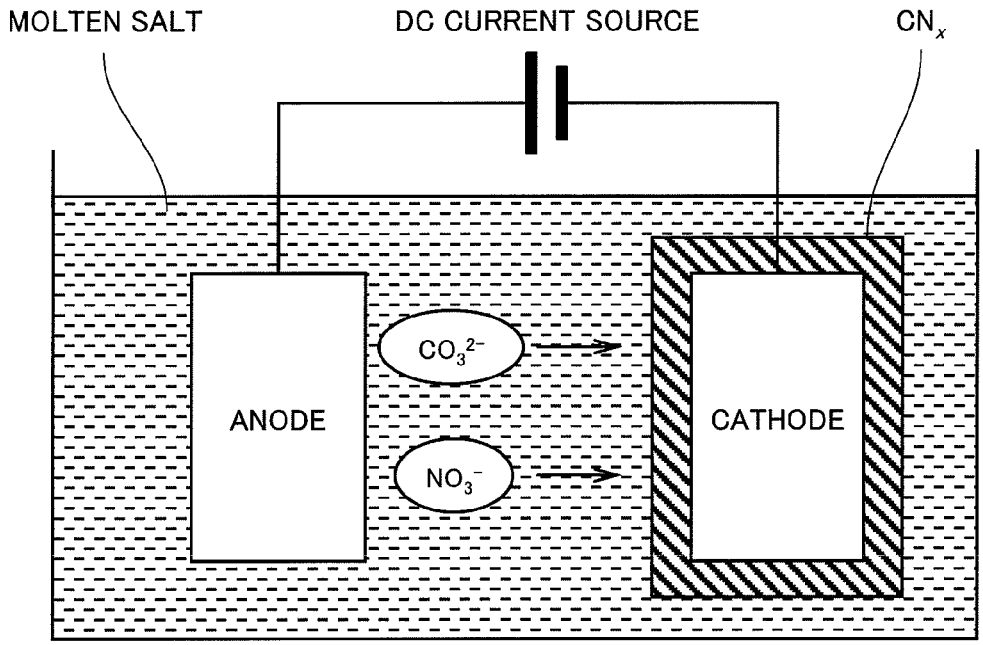
FIG. 1 schematically depicts the principle of the present invention.

FIG. 1 schematically depicts the principle of the present invention. As shown, a conductive substrate acting as cathode and a counter electrode acting as anode are placed in a molten salt electrolyte bath containing carbonate ion ($CO_3^{2-}$) and nitrate ion ($NO_3^-$). The substrate acting as cathode and the counter electrode acting as anode are electrically connected to a DC current source and DC current is applied across the cathode and the anode through the molten salt electrolyte bath. Carbonate ion and nitrate ion are electrochemically reduced on the surface of substrate and reacted to deposit carbon nitride films on the surface of substrate.

The molten salt electrolyte bath used in the present invention is ether (a) a mixture of alkali metal or alkaline earth metal carbonate and an alkali metal or alkaline earth metal nitrate, or (b) an alkali metal or alkaline earth metal halide containing the mixture (a).

Examples of alkali metal and alkaline earth metal carbonates include $Li_2CO_3$, $Na_2CO_3$, $K_2CO_3$, $MgCO_3$, $CaCO_3$ and $BaCO_3$. Examples of alkali metal and alkaline earth metal nitrates include $LiNO_3$, $NaNO_3$, $KNO_3$, $Mg(NO_3)_2$, $Ca(NO_3)_2$ and $Ba(NO_3)_2$.

The alkali metal halides include the fluoride, chloride, bromide and iodide of lithium, sodium, potassium, rubidium and cesium.

The alkaline earth metal halides include the fluoride, chloride, bromide and iodide of magnesium, calcium, strontium and barium.

Mixture of alkali metal halides and mixtures of alkaline earth metal halide may also be employed. A binary mixture of LiCl and KCl is especially preferred. In case of binary mixture of LiCl and KCl, the molar ratio of LiCl:KCl generally ranges between 30%:70% and 100%:0%, preferably between 55%:45% and 65%:35%. A eutectic mixture consisting of 58.5 mol % of LiCl and 41.5 mol % of KCl may also be used.

The molar ratio of nitrate ion to carbonate ion in the molten salt bath is adjusted preferably between 0.01 and 1.0, more preferably 0.02 and 0.5, especially 0.03 and 0.2. The carbonate ion source is dissolved in the molten salt electrolyte bath preferably to a saturated concentration. In case of the molten salt electrolyte bath comprising a binary mixture of LiCl and KCl, for example, $K_2CO_3$ reaches saturation concentration at about 5-6 mol % at about 500° C.

It is preferable to carry out the electrolysis process in an inert gas atmosphere to prevent oxidation or otherwise deterioration of the deposited carbon nitride film at an elevated temperature. It is also preferable to carry out the electrolysis process while stirring or otherwise agitating the electrolyte bath to produce dense carbon nitride films and/or to accelerate the deposition rate of said film.

The bath temperature is kept higher than the melting point of electrolyte. Because the solubilities of carbonate ion source and nitrate ion source increase as the bath temperature elevates, it is possible to produce dense carbon nitride films and/or to accelerate the deposition rate by elevating the bath temperature. On the other hand, the bath temperature is restricted in practice by several factors including the material of electrolyte vessel, handling problems and so on. Therefore, the bath temperature generally ranges between 250° C. and 800° C. and preferably between 350° C. and 700° C.

According to the invention, the following electrochemical reaction takes place on the cathode.

$$CO_3^{2-}+XNO_3^{-}+(4+5X)e^{-}$$

$$\rightarrow CN_x+3(1+X)O^{2-} \quad (1)$$

Thus, the substrate on which carbon nitride film is deposited acts as cathode. Therefore, the substrate acting as cathode is made of an electroconductive material, typically made of metals.

On the counter electrode acting as anode, the following electrochemical reaction takes place.

$$O^{2-}\rightarrow \tfrac{1}{2}O_2+2e^{-} \quad (2)$$

Accordingly, the counter electrode is required to be made of a material which can withstand the above reaction. Commercially available electrodes sold as being suitable as acting anode, as well as nickel ferrite electrodes or diamond electrodes may be used.

Carbonaceous electrodes such as graphite electrodes may also be used as anode. In this case, the following reaction takes place on the carbonaceous anode.

$$3O^{2-}+C(\text{electrode})\rightarrow CO_3^{2-}+4e^{-} \quad (3)$$

Thus carbonate ion is continuously replenished into the molten salt bath until the carbonaceous electrode has been consumed by the above reaction.

It is imperative to carry out the electrolysis process according to the present invention at a potential capable of electrochemically reducing carbonate ion and nitrate ion. In case of LiCl/KCl mixed molten salt bath, carbonate and nitrate ions are electrochemically reduced concurrently at a potential more negative than about 1.2V (vs. $Li^+/Li$). However, at a potential more negative than about 0.4V, carbonate ion is preferentially reduced and smooth carbon nitride films tend not to be obtained. In order to reduce carbonate ion and nitrate ion concurrently, the electrolysis process is carried out at a potential between 0.4V and 1.2 V.

After the reaction, the substrate is taken out from the molten salt bath and then washed to remove adhered electrolyte salt. Any washing method used for washing workpiece treated in the molten salt bath may be employed. For example, the substrate may be washed with deoxygenated warm water. The washing process may be carried out in an atmosphere of inert gas or hydrogen gas.

EXAMPLES

The following examples are offered without intending to limit the present invention thereto.

Examples 1-8

In the examples below, an apparatus as schematically shown in FIG. 1 was used. The molten salt electrolyte bath was consisted of 58.5 mol % of LiCl and 41.5 mol % of KCl. To the molten salt bath were added 5 mol % of $K_2CO_3$ and a varying amount of $KNO_3$ as indicated in Table 1 below. As a substrate acting as cathode, a nickel plate was used. The electrolysis process was carried out at a bath temperature of 500° C. by applying DC current across the substrate and a counter electrode acting as anode through the molten salt bath at a potential of 0.5V in Examples 1-6 and 0.9V in Examples 7-8 (vs. $Li^+/Li$) until a quantity of electricity of 100 $C/cm^2$ was reached.

After the electrolytic processing, the surface of the substrate was examined by the X-ray photoelectron spectroscopy (XPS).

The deposition of carbon nitride film was confirmed by the XPS analysis on the substrates of Examples 6-8.

Figure 2:
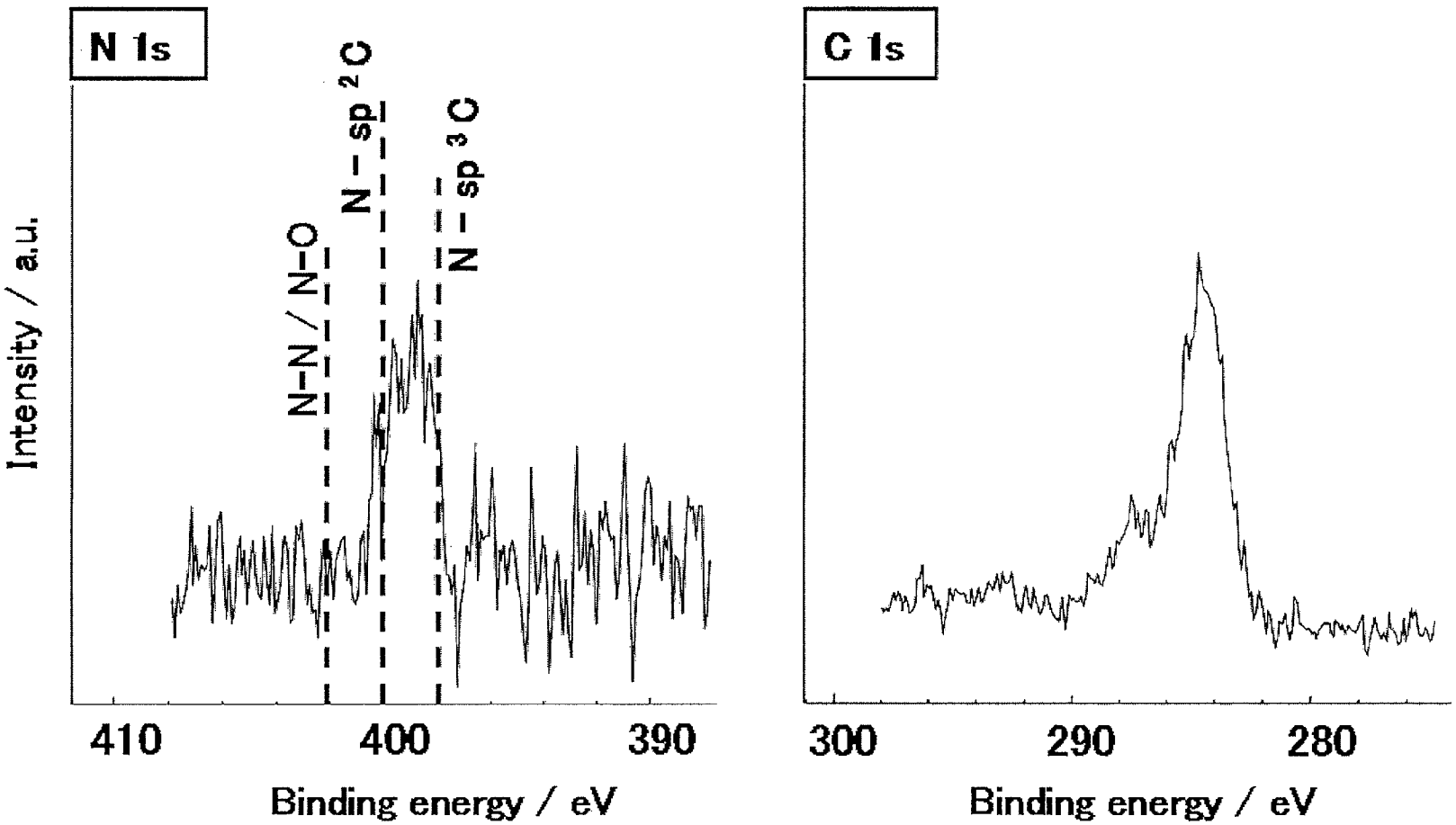
FIG. 2 is XPS spectra of N 1s and C 1s of carbon nitride film produced in Example 6.
Figure 3:
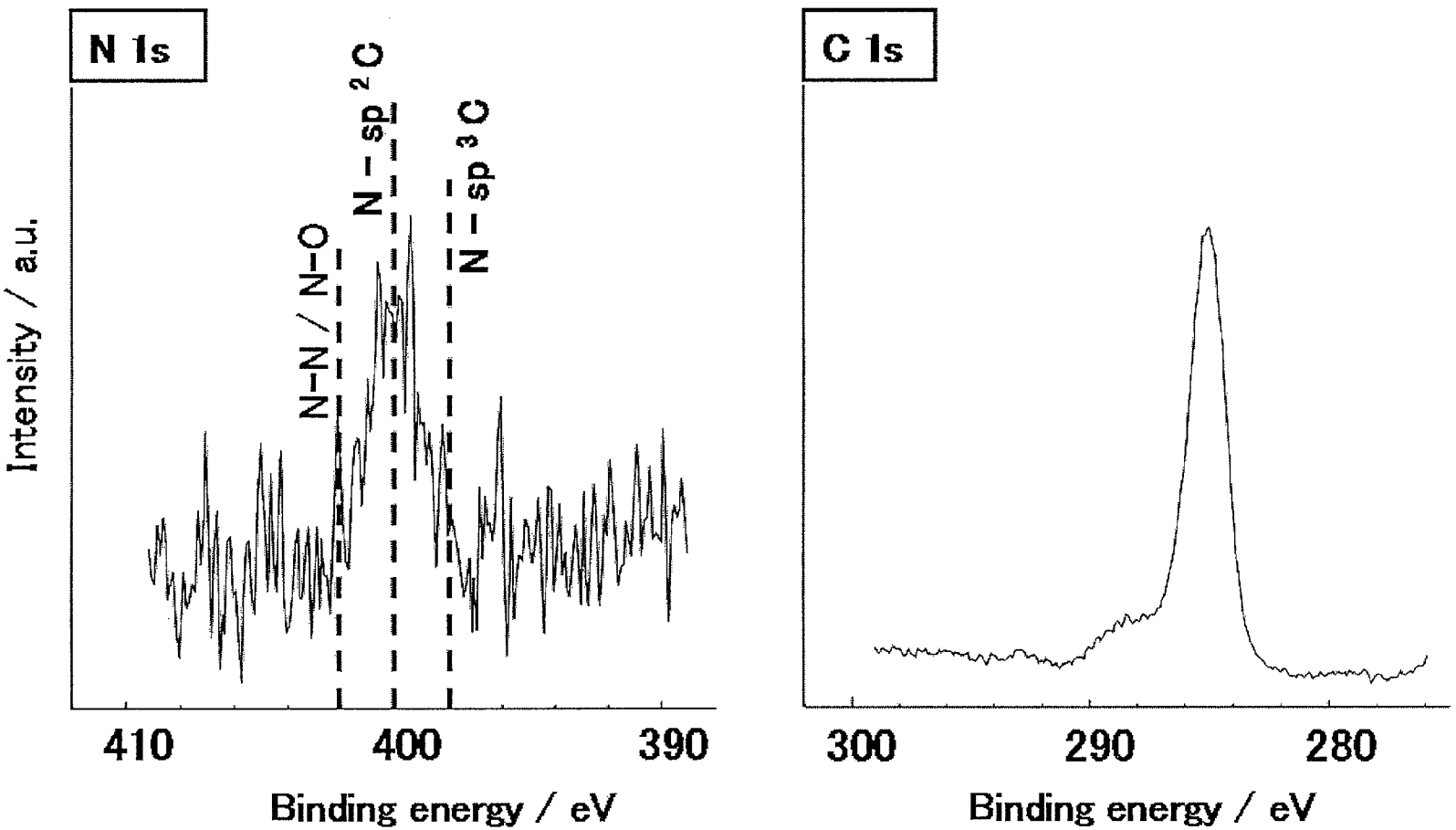
FIG. 3 is similar XPS spectra of N 1s and C 1s of carbon nitride film produced in Example 7.

The XPS spectra of N 1s and C 1s of the deposited film produced in Examples 6 and 7 are shown in FIG. 2 and FIG. 3, respectively. C 1s and N 1s spectra can be seen indicating deposition of carbon nitride film.

In the N 1s spectra of both Examples, in addition to a spectrum at 400.5 eV representing N atom bound to $sp^2$ hybridized orbital of C atom, a spectrum at 398.5 eV presumably representing N atom bound to $sp^3$ hybridized orbital of C atom is observed.

In the C 1s spectra of both Examples, a shoulder may be observed on the high energy side indicating the formation of a carbon nitride compound such as $\beta$-$C_3N_4$.

It was also found that N 1s binding energy was shifted to lower energy side by carrying out the electrolysis at more negative potential. This indicates that the status of C—N binding may be controlled by varying the electrolysis potential.

The substrates treated in Examples 3-5 were also examined by the XPS analysis but any occurrence of a carbon nitride compound was not confirmed by this method. However, due to remarkable change in the cathodic reaction and the deposited product on the substrate acting as cathode, it was presumed that a carbon nitride compound was produced in fact even in a very small amount.

Finally, no evidence of the formation of a carbon nitride compound was observed on the substrates of Examples 1 and 2 in the XPS analysis. Moreover, remarkable changes in the cathode reaction and the deposited product on the cathode indicating the formation of a carbon nitride compound were not observed.

Example 8 demonstrates that a satisfactory result may be achieved at a molar ratio of nitrate ion to carbonate ion as high as 0.2. However, the amount of deposited carbon nitride decreases inversely proportionally to the molar ratio of nitrate ion to carbonate ion above 0.2. Therefore, it is preferable to avoid the ratio of nitrate ion to carbonate ion in excess of 1.0.

TABLE 1

| | EXAMPLES | | | |
|---|---|---|---|---|
| | 1 | 2 | 3 | 4 |
| Molten salt | LiCl—KCl | | | |
| $K_2CO_3$, mol % | 5.0 | | | |
| $KNO_3$, mol % | 0.01 | 0.03 | 0.05 | 0.07 |
| $NO_3^-/CO_3^{2-}$ | 0.002 | 0.006 | 0.01 | 0.014 |
| Observation | C | C | B | B |

| | EXAMPLES | | | |
|---|---|---|---|---|
| | 5 | 6 | 7 | 8 |
| Molten salt | LiCl—KCl | | | |
| $K_2CO_3$, mol % | 5.0 | | | |
| $KNO_3$, mol % | 0.10 | 0.15 | 0.5 | 1.0 |
| $NO_3^-/CO_3^{2-}$ | 0.02 | 0.03 | 0.1 | 0.2 |
| Observation | B | A | A | A |

Remarks:
A: Production of carbon nitride was observed by XPS.
B: Production of carbon nitride was not observed by XPS but presumed to have occurred.
C: Production of carbon nitride was neither observed by XPS nor presumed to have occurred.

The invention claimed is:

1. A method for electrochemically depositing a carbon nitride film on a conductive substrate comprising:

providing a molten salt electrolyte bath containing a source of carbonate ion and a source of nitrate ion;

placing said substrate and a counter electrode in said electrolyte bath, said substrate and said counter electrode being electrically connected to a DC current source and acting as cathode and anode, respectively; and applying DC current across said substrate and said counter electrode through said electrolyte bath whereby said carbonate ion and said nitrate ion are electrochemically reduced concurrently to deposit a carbon nitride film on the substrate.

2. The method according to claim 1 wherein said carbonate ion source is an alkali metal or alkaline earth metal carbonate and wherein said nitrate ion source is an alkali metal or alkaline earth metal nitrate.

3. The method according to claim 1 wherein said molten salt electrolyte bath comprises a metal halide selected from the group consisting of an alkali metal halide, an alkaline earth metal halide and a mixture thereof containing said carbonate ion source and said nitrate ion source dissolved therein.

4. The method according to claim 1 wherein said molten salt electrolyte bath comprises a binary mixture of lithium chloride and potassium chloride containing potassium carbonate and potassium nitrate dissolved therein.

5. The method according to claim 1 wherein the molar ratio of nitrate ion to carbonate ion is adjusted to be between 0.01 and 1.0.

6. The method according to claim 5 wherein said molar ratio is between 0.02 and 0.2.

7. The method according to claim 1 wherein said molten salt electrolyte bath is maintained at a bath temperature from 250° C. to 800° C.

8. The method according to claim 7 wherein said bath temperature is from 350° C. to 700° C.

9. The method according to claim 1 wherein DC current is applied at a potential at which both carbonate ion and nitrate ion are concurrently reduced on the surface of said substrate.

10. The method according to claim 4 wherein DC current is applied at a potential between 0.4V and 1.2V (vs. $Li^+/Li$).

11. A method for electrochemically depositing a carbon nitride film on a conductive substrate comprising:

providing a molten salt electrolyte bath comprising a binary mixture of lithium chloride and potassium chloride;

dissolving potassium carbonate and potassium nitrate in said molten salt electrolyte bath;

placing said substrate and a counter electrode in said electrolyte bath, said substrate and said counter electrode being electrically connected to a DC current source and acting as cathode and anode, respectively; and applying DC current across said substrate and said counter electrode through said electrolyte bath whereby said carbonate ion and said nitrate ion are electrochemically reduced concurrently to deposit a carbon nitride film on the substrate.

12. The method according to claim 11 wherein the molar ratio of LiCl:KCl in said binary mixture is from 55:45 to 65:35.

13. The method according to claim 11 wherein said potassium carbonate is dissolved in said binary mixture in molten state to the saturation point and wherein said potassium nitrate is dissolved in said binary mixture at a molar ratio of nitrate ions to carbonate ions from 0.02 to 0.2.

14. The method according to claim 11 wherein said molten salt electrolyte bath is maintained at a bath temperature from 350° C. to 700° C.

15. The method according to claim 14 wherein said bath temperature is about 500° C.

16. The method according to claim 11 wherein DC current is applied at a potential from 0.4V to 1.2V (vs. $Li^+/Li$).

* * * * *